US007375736B2

(12) United States Patent
Kao et al.

(10) Patent No.: US 7,375,736 B2
(45) Date of Patent: May 20, 2008

(54) TEST METHOD FOR VGA WITH OVERCLOCK FREQUENCY AND A VGA SYSTEM THEREOF

(75) Inventors: Chin-Jun Kao, Taipei (TW); Wei-Sen Tang, Taipei (TW)

(73) Assignee: First International Computer Inc., Taipei (TW)

( * ) Notice: Subject to any disclaimer, the term of this patent is extended or adjusted under 35 U.S.C. 154(b) by 732 days.

(21) Appl. No.: 10/932,119

(22) Filed: Sep. 2, 2004

(65) Prior Publication Data

US 2006/0044219 A1 Mar. 2, 2006

(30) Foreign Application Priority Data

Nov. 28, 2003 (TW) ..... 092133581

(51) Int. Cl.
*G09G 5/00* (2006.01)

(52) U.S. Cl. ..... 345/904; 345/419; 324/770

(58) Field of Classification Search ..... 345/904, 345/419; 324/770; 348/180; 703/20; 702/71
See application file for complete search history.

(56) References Cited

U.S. PATENT DOCUMENTS 5,987,081 A * 11/1999 Csoppenszky et al. ..... 375/354
6,263,290 B1 * 7/2001 Williams et al. ..... 324/76.12
6,397,173 B1 * 5/2002 Campbell et al. ..... 703/20

* cited by examiner

*Primary Examiner*—Kevin M Nguyen

(57) ABSTRACT

A method for testing overclock frequency of VGA includes the following steps. Step A is to receive a new clock parameter of a GPU and a new memory clock parameter, which determine the operation of the VGA. Step B is to make use of the clock parameter of the GPU and the memory clock parameter received from step A to set up the VGA through a software approach so that the VGA is operating with the clock parameters. Step C is to call three dimensional application program interfaces so that the VGA within the pre-defined time limit can execute to show a three dimensional picture in a window and output the three dimensional picture to the display connected to the VGA and executing the lighting instruction, create mesh instruction, object rotation instruction, spherical warp instruction and 3D immediate mode instruction so as to normally display the three dimensional picture. Step D is to determine whether the three dimensional picture has been normally shown on the display, the clock parameters from Step A being accepted in case of being true and an original clock parameter of the GPU and an original memory clock parameter being restored in case being not true.

16 Claims, 6 Drawing Sheets

TEST METHOD FOR VGA WITH OVERCLOCK FREQUENCY AND A VGA SYSTEM THEREOF

FIELD OF THE INVENTION

The present invention relates to a test method of VGA (Video Graphics Adapter) and particularly to a test method for a VGA with overclock frequency.

BACKGROUND OF THE INVENTION

Usually, overclock frequency software offered by manufactures of conventional VGA (Video Graphics Adapter) or by program developers of VGA only provides warning message of risk value range for high frequency. Actually, in order to know if the VGA can work normally in an environment of high frequency assigned by the user, it is a unique test way that three dimensional gaming software is loaded in to see the stability of VGA under such high frequency. However, it is very possible for the VGA working under so high frequency to occur overclock frequency failure and result in computer shut down. And, even more, important data in the gaming software may become lost.

When the VGA is set at a certain operating frequency, three dimensional performance test software (3D Mark) can be adopted to carry out the test. But the test way is considerably time consumption and the computer may be shut down due to the VGA incapable of enduring the burden during testing. Meanwhile, output test results of the 3D performance test software generally are graphs or data, which are hard to be understood by ordinary users. Further, the cost of 3D performance test software is extremely high so that it is also a cost burden to the ordinary users.

SUMMARY OF THE INVENTION

A main object of the present invention is to provide a test method for VGA with overclock frequency and a VGA system thereof, which can process a basic 3D instruction test first to provide precognition of 3D gaming software being unstable in case of 3D preview picture appearing unstable, distorted shape or incorrect figure sticking during the basic 3D instruction test, such that it is capable of preventing the computer from being shut down and losing important data of the gaming software.

A second object of the present invention is to provide a test method for VGA with overclock frequency and a VGA system thereof, which can acknowledge overclock frequency range of the VGA.

A third object of the present invention is to provide a test method for VGA with overclock frequency and a VGA system thereof, which is possible to know the overclock frequency capability in a very short time.

A fourth object of the present invention is to provide a test method for VGA with overclock frequency and a VGA system thereof, which can carry overclock frequency capability test for the VGA without risk of computer being shut down.

A fifth object of the present invention is to provide a test method for VGA with overclock frequency and a VGA system thereof, which is possible for the tester to check if the overclock frequency capability for the VGA can pass the test.

In order to achieve the preceding objects, the test method for VGA with overclock frequency according to the present invention includes: (A) receiving a new clock parameter of a GPU (Graphics Processing Unit) and a new memory clock parameter, which determine the operation of the VGA; (B) making use of the clock parameters received from step (A) to set up the VGA through a software approach so that the VGA is operating with the clock parameters; (C) calling three dimensional application program interfaces so that the VGA within the pre-defined time limit can execute to show a three dimensional picture in a window and output the three dimensional picture to the display connected to the VGA, wherein a step for executing showing of the three dimensional picture further comprises executing a lighting instruction, creating a mesh instruction, an object rotation instruction, a spherical warp instruction and a 3D immediate mode instruction so as to normally display the three dimensional picture; (D) determining whether the three dimensional picture has been normally shown on the display, the clock parameter of the GPU and the memory clock parameter from Step (A) being accepted in case of being true and an original clock parameter of the GPU and an original memory clock parameter being restored in case being not true.

Next, in order to achieve the preceding objects, a VGA system with overclock frequency according to the present invention includes a VGA and a test module, being implemented with program codes on a computer connected to the VGA. The test module further includes following instructions: instructions of receiving a new clock of a GPU parameter and a new memory clock parameter, which determine the operation of the VGA; instructions of making use of the clock parameters received to set up the VGA through a software approach so that the VGA is operating with the clock parameters; instructions of calling three dimensional application program interfaces so that the VGA within the pre-defined time limit can execute to show a three dimensional picture in a window and output the three dimensional picture to the display connected to the VGA, wherein a step for executing showing the three dimensional picture further comprises executing a lighting instruction, creating a mesh instruction, an object rotation instruction, a spherical warp instruction and a 3D immediate mode instruction so as to normally display the three dimensional picture; and instructions of determining whether the three dimensional picture has been normally shown on the display, the clock parameter of the GPU and the memory clock parameter being accepted in case of being true and an original clock parameter of the GPU and an original memory clock parameter being restored in case being not true.

BRIEF DESCRIPTION OF THE DRAWINGS

The present invention can be more fully understood by reference to the following description and accompanying drawings, in which.

DETAILED DESCRIPTION OF THE INVENTION

Figure 1:
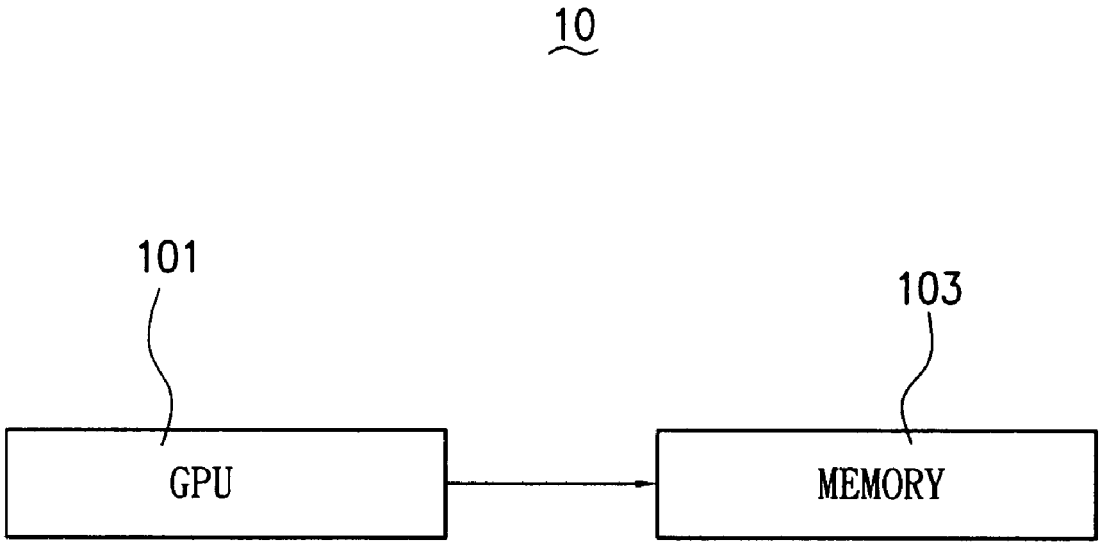
FIG. 1 is a block diagram illustrating a structure of VGA applying a method according to the present invention.
Figure 2:
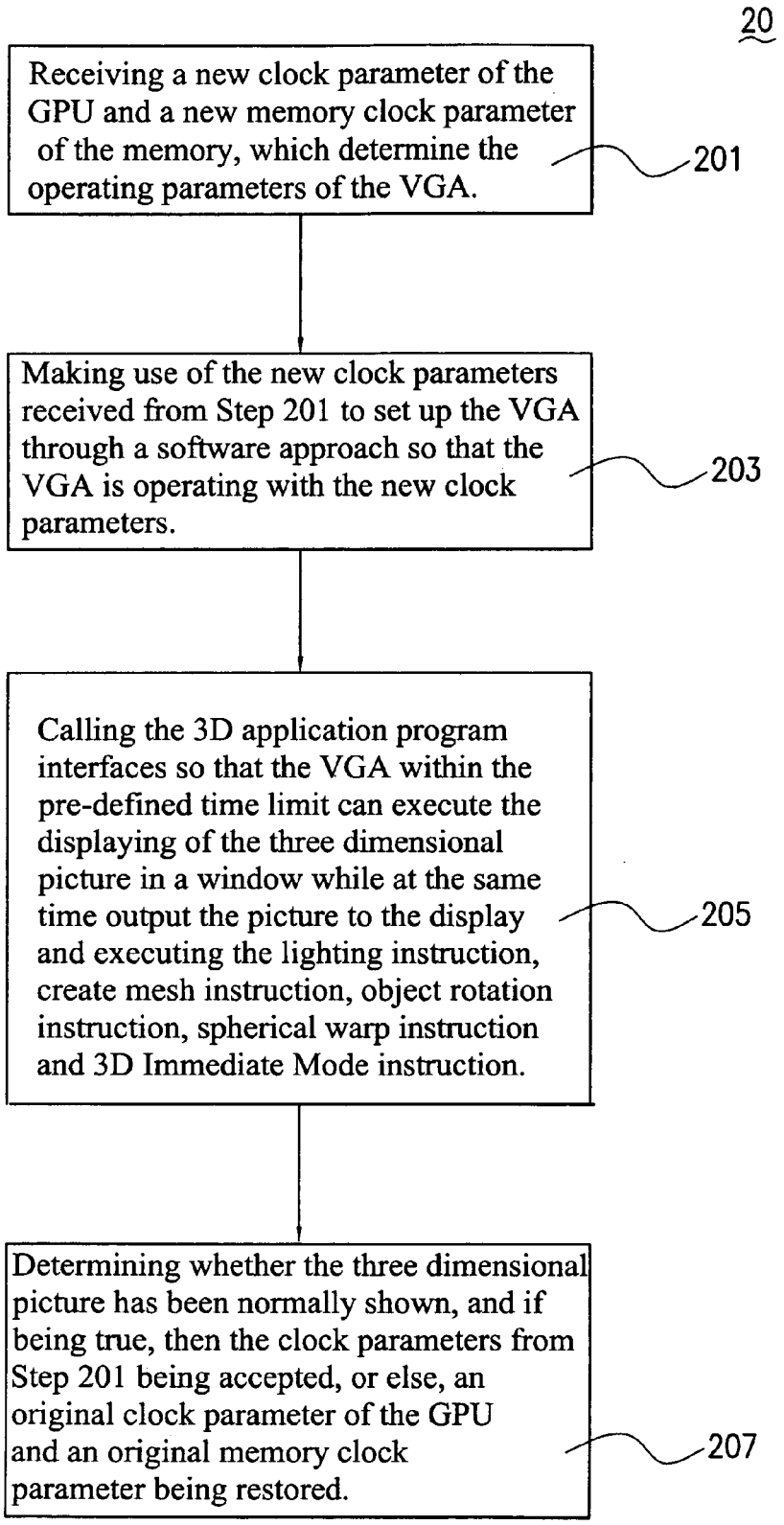
FIG. 2 is a flow chart of the method according to the present invention.

FIG. 1 shows a block diagram illustrating the structure of the VGA with a method according to the present invention while FIG. 2 shows the flow chart of the method according to the present invention. The test method 20 according to the present invention can be implemented on a video graphics adapter 10 (VGA) shown in FIG. 1. The VGA 10 should best be equipped with the 3D (Three-Dimension) picture processing capability such as Microsoft compatible DirectX application program interfaces and Direct3D application program interfaces. Test method 20 essentially focuses on whether the VGA 10 is capable of functioning properly and displaying the picture normally under a slightly higher clock parameter of the GPU (Graphics processing unit) and a memory clock parameter, especially to display correctly the 3D pictures. Test method 20 includes steps 201, 203, 205 and 207, which will be explained as follow respectively.

Step 201 is to receive a new clock parameter of the GPU and a memory clock parameter of the memory , which determine the operating parameters of the VGA 10. Please refer to FIG. 3, which is an illustration of a human-machine interface for inputting the clock parameter of the GPU and the memory clock parameter according to the present invention. The human-machine interface 30 can be a window application program executed on the computer to display on the monitor as a frame similar to FIG. 3 and making use of the input interfaces 301 and 303 in order to adjust the value of the clock parameter of the GPU and the memory clock parameter.

Step 203 is to make use of the clock parameter of the GPU and the memory clock parameter received from Step 201 to set up the VGA 10 through a software approach so that the VGA 10 is operating with the new GPU clock parameter and memory clock parameter. After assigning the clock parameter of the GPU and the memory clock parameter through human-machine interface 30, and then making use of input interface 305, for example the "TEST" button of the input interface 305, the Graphics processing unit 101 will be assigned to operate with the GPU clock parameter while the memory 134 will be assigned with the memory clock parameter. Thus, the VGA 10 can be operating under the setting of the clock parameter of the GPU and the memory clock parameter and immediately right after the completion of the assignments, the testing will be performed on the VGA 10.

Figure 4:
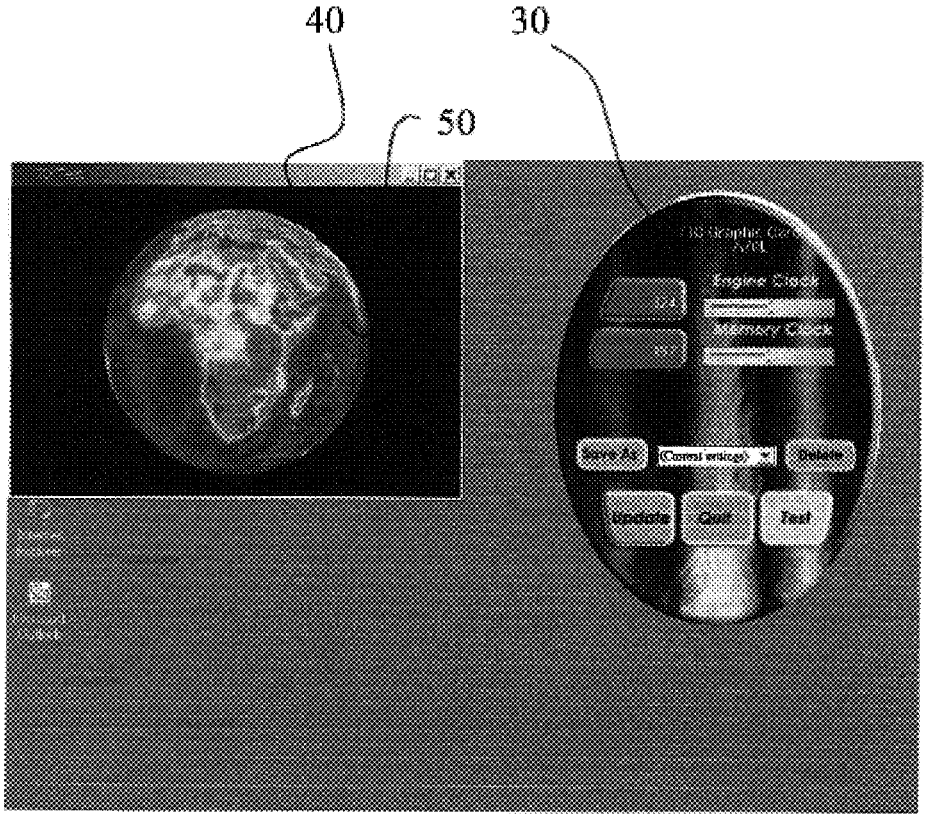
FIG. 4 is a screen image illustrating a test frame of overclock frequency VGA normally executing three-dimensional picture according the present invention.

Step 205 is to call the 3D application program interfaces so that the VGA 10 within the pre-defined time limit can execute the displaying of the three dimensional picture 50 in a window 40 while at the same time output the three dimensional picture 50 to the display connected to the VGA 10 and executing the lighting instruction, create mesh instruction, object rotation instruction, spherical warp instruction and 3D immediate mode instruction so as to normally display the three dimensional picture 50. Referring to FIG. 4, which shows a screen image illustrating a test frame of overclock frequency VGA normally executing three-dimensional picture according the present invention, the actual implementation of three dimensional picture 50 in FIG. 4 is a continuous rotating Earth. VGA 10 under the overclock frequency condition must at least be able to normally execute lighting, create mesh, object rotation, spherical wrap, and 3D immediate mode instructions so that the three-dimensional picture 50 can be correctly displayed in the window 40. The execution time of Step 205 for displaying the three-dimensional picture 50 in window 40 can be, for example, fixed to be just 5 seconds. This in term means that the VGA 10 will be performed a 5 seconds overclock frequency test in order to check whether the VGA 10 can correctly display the three dimensional picture 50 of the continuous rotating earth in the window 40 within these 5 seconds. The element determining the length of the pre-defined time is mainly the time required to complete the display of the three dimensional picture 50 which also imply the completion of executing the lighting instruction, create mesh instruction, object rotate instruction, spherical warp, and 3D immediate mode instruction and others within the pre-defined time so that the three dimensional picture 50 can be displayed.

The previous mentioned Step 205 besides maintaining the VGA 10 to execute the display of the three dimensional picture 50 in window 40 within the pre-defined time, it can further execute the instructions to inform the VGA 10 to stop performing the test on the VGA 10. The actual implementation of this is by receiving the signal that the ESC key of the keyboard is being pressed within the pre-defined time so that the test on VGA 10 will be stopped immediately.

Figure 5:
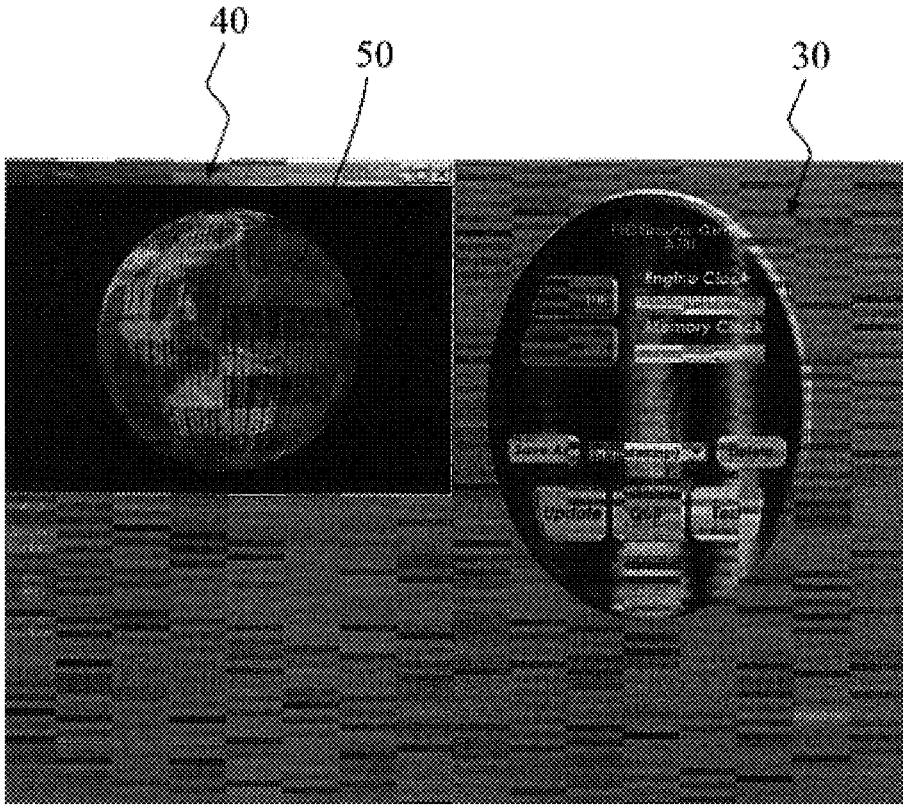
FIG. 5 is a screen image illustrating a test frame of overclock frequency VGA abnormally executing three-directional picture.

Step 207 is to determine whether the three dimensional picture 50 has been normally shown on the display. If it is true, then it will accept the setting of the clock parameter of the GPU and the memory clock parameter from Step 201 on the VGA 10, or else, the VGA 10 will revert back to the original working clock parameter of the GPU and the original working memory clock parameter. Referring to FIG. 5, which shows a screen image illustrating a test frame of overclock frequency VGA abnormally executing three dimensional picture 50. If the frame of the display is able to maintain its normal showing even after the execution of the three dimensional picture 50 display in the pre-defined time, then by using the human-machine interface 30 to renew the graphics processing unit 101 to function with the clock parameter of the GPU according to Step 201 and as well renew the memory 103 to the memory clock parameter from Step 201. However, after the execution of the three dimensional picture 50 in the pre-defined time, if the frame of the display appeared to be that shown in FIG. 5 under abnormal situation, e.g., frame with distortion or spots, then it is clear that VGA 10 will fail under the 3D overclock frequency environment and therefore will revert back to the original working clock parameter of the GPU and the original working memory clock parameter. This indicates that the VGA 10 is unable to function normally in the overclock frequency condition according to the clock parameter of the GPU and the memory clock parameter in Step 201. When the user completes the execution of window 40 in FIG. 5 and execution of the human-machine interface 30, the failure of the overclock frequency VGA 10 will not cause the computer to stop operating or shut down. However, the computer will still be able to function normally.

Figure 3:
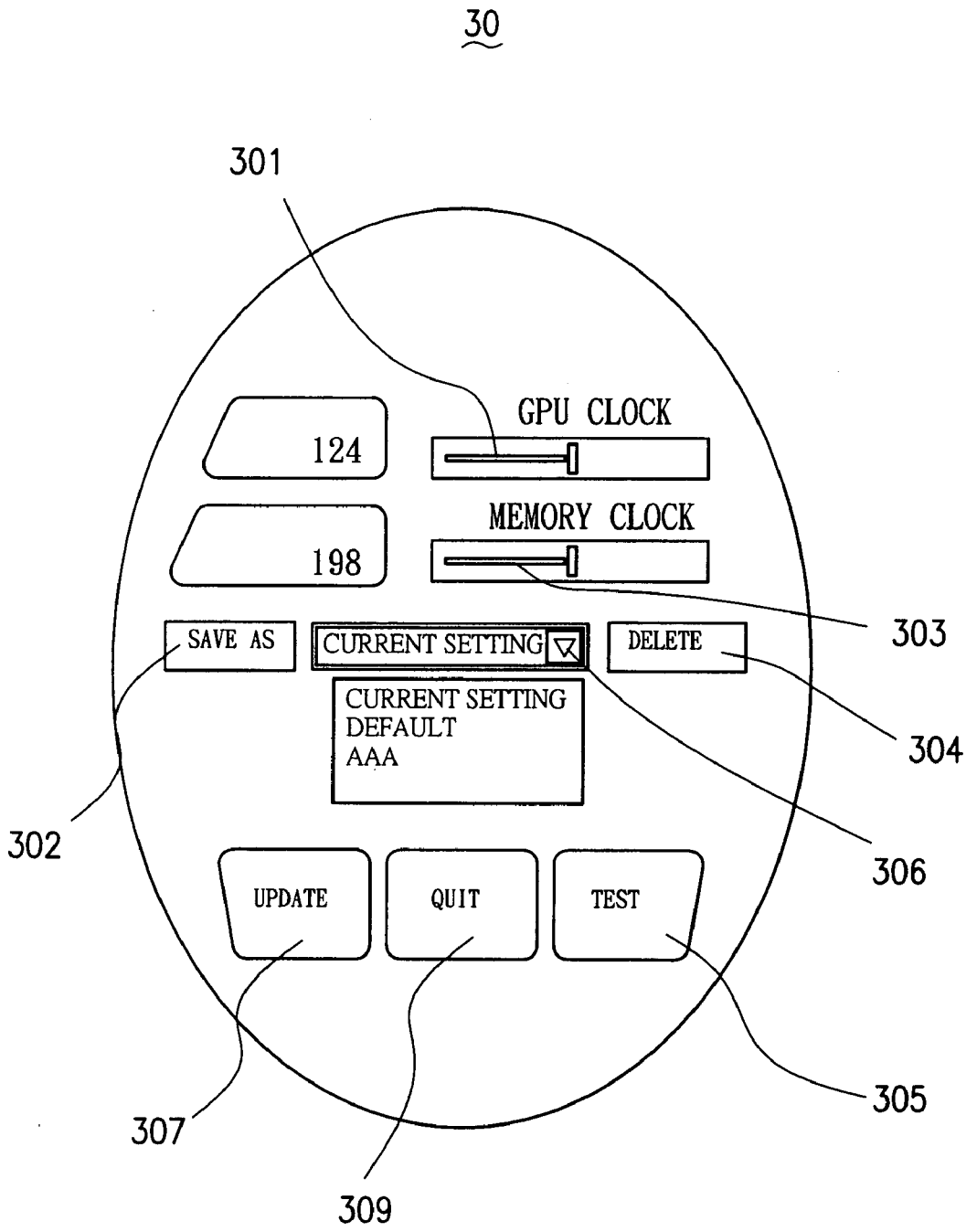
FIG. 3 is an illustration of a human-machine interface for inputting a clock parameter of a GPU and a memory clock parameter according to the present invention.

To further illustrate the operation of the human-machine interface 30 in FIG. 3, the tester making use of the input interface 301 and 303 to assign the desired clock parameter of the GPU and the desired memory clock parameter of the overclock frequency and later using the input interface 305 to carry out the overclock frequency test. If the overclocking is successful, the tester can make use of the input interface 307 to change the setting of the VGA 10 according to the clock parameter of the GPU and the memory clock parameter of the overclock frequency. Furthermore, the tester is able to use the input interface 309 to minimize whole frame of the human-machine interface 30 and the input interface 302 will also allow the tester to save file setting according to the selection in the pull-down menu 306. The tester is also able to use the input interface 304 to delete the selection in the pull-down menu 306 and of course, the default value option will be stored permanently and not available for deletion.

Figure 6:
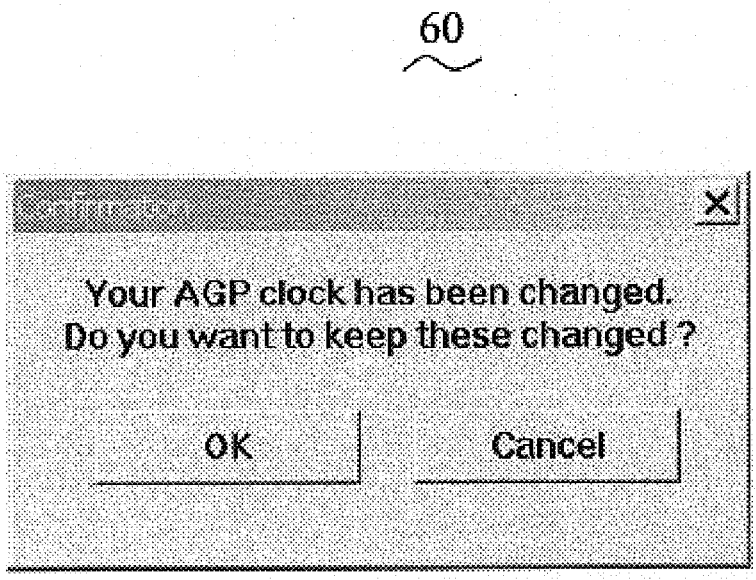
FIG. 6 is a dialog box of human-machine interface according to the present invention.

The test method 20 according to the present invention further provides a dialog human-machine interface 60. The timing for showing the dialog human-machine interface 60 of the present invention can be set to replace the window 40 on the display after the window 40 closes itself after the pre-defined time. Referring to FIG. 6, which shows a dialog box of human-machine interface according to the present invention, the main objective of the dialog human-machine interface 60 is to allow the tester to verify the changes going to be made to the clock parameter of the GPU and the memory clock parameter of the VGA 10.

The 3D instructions used in the Step 205 of the test method 20 according to the present invention, are primarily some basic functions that will be utilized by any ordinary 3D gaming software nowadays. If VGA 10 is able to pass the test method 20 under the assigned clock parameter of the GPU and the assigned memory clock parameter, this will thus provide a positive support for the VGA 10 to execute at overclock frequency in the 3D gaming software. Test method 20 according to the present invention further illustrates the reasons why these 3D instructions are chosen to display the three dimensional picture 50 in a more technical aspect:

1. Lighting instruction is to provide the light so that an object will be visible in the 3D environment as the picture is formed from the light rays reflected off the object surface from different light sources. At the same time, the light sources, in the gaming software, when positioned at different angles will form a surrounding effect. Therefore, the Lighting instruction plays one important element in the whole three dimensional structure.
2. Spherical objects are usually formed with multiple polygon grids so that the grid size, shape and face normal have to be defined. The basic body structure of most of the humans and monsters often appearing in the 3D gaming software are formed with the grids, therefore, the create mesh instruction provides this particular functionality.
3. Objects are stationary after their creation, the coordinate system, rotational axle, moving or rotating speed must be defined so that the moving effect of the 3D objects can be really initiated. For example, in order for the human character to run in the gaming software, the movement of the human model is required and this is provided by the object rotate instruction.
4. If the object only has the grid, it will just display the outline for the shape of the object. Warp must be applied to the surface of the object to establish the warp coordinates and warp mode so that the object surface will display the correct picture. For instance, the clothing and helmet of the human character inside gaming software are accomplished with the warp. The spherical warp is to provide this particular function.
5. The Direct3D interface from Microsoft includes retained mode and immediate mode. The processing method of the retained mode is considered more of the high level, thus more suitable for beginners to use. The processing method of the immediate mode is considered to be part of the low level where the programming is more complex but it provides a better executing efficiency. Usually, the gaming software is more likely to adopt the 3D immediate mode processing method.

The three dimensional picture 50 adopted by the present invention is a three dimensional picture displayed mainly through the execution of the lighting, create mesh, object rotate, spherical warp and 3D immediate mode instructions. Therefore, the three dimensional picture 50 is not confined to just the rotating earth planet, other dynamic forms of the three dimensional picture can be human character or three dimensional model. Any three dimensional picture 50 is suitable as long as it executes all the preceding mentioned instructions in order to display the picture. The three dimensional picture 50 adopted in the present invention is best suited by a three dimensional picture that any ordinary user is familiar with so that it is easier to differentiate between the good and poor of the image.

In the example of the three dimensional picture 50 showing the rotating Earth according to the present invention, and with the capability of the current computer hardware nowadays, the time required to display the rotating Earth is roughly less than half a second. Therefore, in order to further explore the overclock frequency capability of the VGA 10, the present invention, in certain time period e.g. 5 seconds, will continuously display the rotating earth on the computer. During this period, when the rotating Earth is displayed, the frame of the display is able to maintain the normal operation or it can also abnormally show the frame on the display. No matter which ever is the case, the present invention will never cause the computer to crash or shut down. Furthermore, during the testing process, the present invention can stop the test on the VGA 10 when it receives the signal that the 'ESC' key of the keyboard has been pressed. Thus, the test method 20 according to present invention can be considered to be a fast, safe and completely crash-proof method. At the same time, the easily visible test result of the three dimensional picture 50 will allow the tester to easily identify the overclock frequency level that the VGA 10 is capable of.

Test method 20 according to the present invention can be implemented by adopting the program code approach. For example, the test method 20 can be implemented as a test module in window application software so that if the user wishes to carry out the overclock frequency test on the VGA 10 of the computer, he just needs to execute the test module and will be able test the overclock frequency capability of the VGA 10 before hand.

While the invention has been described with reference to the a preferred embodiment thereof, it is to be understood that modifications or variations may be easily made without departing from the spirit of this invention, which is defined by the appended claims.

What is claimed is:

1. A method for testing overclock frequency of VGA (Video Graphics Adapter), comprising:

(A) receiving a new clock parameter of a GPU (Graphics Processing Unit) and a new memory clock parameter, which determine the operation of the VGA;

(B) making use of the clock parameter of the GPU and the memory clock parameter received from step (A) to set up the VGA through a software approach so that the VGA is operating with the clock parameter of the GPU and the memory clock parameter;

(C) calling three dimensional application program interfaces so that the VGA within the pre-defined time limit can execute to show a three dimensional picture in a window and output the three dimensional picture to the display connected to the VGA, wherein the step for executing showing of the three dimensional picture further comprises executing a lighting instruction, creating a mesh instruction, an object rotation instruction, a spherical warp instruction and a 3D immediate mode instruction so as to normally display the three dimensional picture; and (D) determining whether the three dimensional picture has been normally shown on the display, the clock parameter of the GPU and the memory clock parameter from Step (A) being accepted in case of being true and an original clock parameter of the GPU and an original memory clock parameter being restored in case being not true.

2. The method as claimed in claim 1, wherein the application program interfaces are Microsoft compatible DirectX application program interfaces.

3. The method as claimed in claim 1, wherein the three dimensional picture is earth shaped.

4. The method as claimed in claim 1, wherein the three dimensional picture is shown by way of executing a lighting instruction, creating a mesh instruction, an object rotation instruction, a spherical warp instruction and a 3D immediate mode instruction.

5. The method as claimed in claim 1, wherein the window is belonged to Microsoft window operation environment.

6. The method as claimed in claim 1, wherein the pre-defined time limit is time duration at least required for completing the three dimensional picture display.

7. The method as claimed in claim 1, wherein the VGA within the pre-defined time limit being capable of executing to show a three dimensional picture in step C further comprises notifying the test being stopped immediately.

8. The method as claimed in claim 1, further comprising a dialog box human-machine interface for reconfirming if the clock parameter of the GPU and the memory clock parameter are changed.

9. A VGA (Video Graphics Adapter) system utilized for overclock frequency, comprising a VGA; and a test module, being implemented with program codes on a computer connected to the VGA;

wherein the test module further comprises following instructions:

instructions of receiving a new clock parameter of a GPU (Graphics Processing Unit) and a new memory clock parameter, which determine the operation of the VGA;

instructions of making use of the clock parameter of the GPU and the memory clock parameter received to set up the VGA through a software approach so that the VGA is operating with the clock parameter of the GPU and the memory clock parameter;

instructions of calling three dimensional application program interfaces so that the VGA within the pre-defined time limit can execute to show a three dimensional picture in a window and output the three dimensional picture to the display connected to the VGA, wherein the step for executing showing the three dimensional picture further comprises executing a lighting instruction, creating a mesh instruction, an object rotation instruction, a spherical warp instruction and a 3D immediate mode instruction so as to normally display the three dimensional picture; and instructions of determining whether the three dimensional picture has been normally shown on the display, the clock parameter of the GPU and the memory clock parameter being accepted in case of being true and an original clock parameter of the GPU and an original memory clock parameter being restored in case being not true.

10. The VGA system as claimed in claim 9, wherein the application program interfaces are Microsoft compatible DirectX application program interfaces.

11. The VGA system as claimed in claim 9, wherein the three dimensional picture is earth shaped.

12. The VGA system as claimed in claim 9, wherein the three dimensional picture is shown by way of executing a lighting instruction, creating a mesh instruction, an object rotation instruction, a spherical warp instruction and a 3D immediate mode instruction.

13. The VGA system as claimed in claim 9, wherein the window is belonged to Microsoft window operation environment.

14. The VGA system as claimed in claim 9, wherein the pre-defined time limit is time duration at least required for completing the three dimensional picture display.

15. The VGA system as claimed in claim 9, wherein the test module further comprise the instructions to inform the VGA to stop performing the test instructions.

16. The VGA system as claimed in claim 9, wherein the test module further comprises a dialog box human-machine interface for reconfirming if the clock parameter of the GPU and the memory clock parameter are changed.

* * * * *